US005826798A

United States Patent [19]

Schindler et al.

[11] Patent Number: 5,826,798

[45] Date of Patent: Oct. 27, 1998

[54] ATOMIZER WITH ARRAY OF DISCHARGE HOLES TO PROVIDE IMPROVED COMBUSTION EFFICIENCY AND PROCESS

[75] Inventors: Edmund S. Schindler, Fairfield; John P. Guarco, Wolcott, both of Conn.

[73] Assignee: Todd Combustion, Shelton, Conn.

[21] Appl. No.: 724,442

[22] Filed: Oct. 1, 1996

[51] Int. Cl.[6] ..... B05B 7/10; F23D 11/38

[52] U.S. Cl. ..... 239/403; 239/418; 239/463; 239/548

[58] Field of Search ..... 239/399, 403, 239/405, 406, 418, 429, 430, 433, 427, 463, 548, 556

[56] References Cited

U.S. PATENT DOCUMENTS

| | | | |
|---|---|---|---|
| 1,427,910 | 9/1922 | Quinn . | |
| 1,800,476 | 4/1931 | Schneider . | |
| 2,414,459 | 1/1947 | Fletcher | 239/429 X |
| 2,942,790 | 6/1960 | Starkey et al. | 239/405 |
| 4,002,297 | 1/1977 | Pillard | 239/429 |
| 4,383,649 | 5/1983 | Reed et al. | 239/429 |
| 4,699,587 | 10/1987 | Shimoda et al. | 431/354 |
| 4,708,293 | 11/1987 | Graziadio et al. | 239/433 X |
| 4,784,043 | 11/1988 | Kobayashi et al. | 110/264 |
| 4,790,480 | 12/1988 | Rennie | 239/498 |
| 5,143,297 | 9/1992 | De Michele et al. | 239/433 X |
| 5,158,443 | 10/1992 | Miyake | 431/8 |
| 5,176,324 | 1/1993 | Furuse et al. | 239/419 |
| 5,368,230 | 11/1994 | Oppenberg | 239/132.5 |

OTHER PUBLICATIONS

Low $NO_x$ Burner Retrofits to 240 MW, 300 MW and 400 MW Oil/Gas Fired Utility Boilers, Final Performance Results and Lessons Learned Brochure, J.J. Kuretski, Jr. et al.

*Primary Examiner*—Lesley D. Morris
*Attorney, Agent, or Firm*—Hedman, Gibson & Costigan, P.C.

[57] ABSTRACT

An apparatus and process in which an atomizer is provided with an array of discharge holes located a distance from the atomizer whirling chamber greater than 400/512 times the radius of the whirling chamber.

17 Claims, 3 Drawing Sheets

ATOMIZER WITH ARRAY OF DISCHARGE HOLES TO PROVIDE IMPROVED COMBUSTION EFFICIENCY AND PROCESS

FIELD OF THE INVENTION

The invention relates generally to apparatus for dispersing fluids and more specifically to a method and apparatus for atomizing liquids. In particular, the invention relates to an atomizer or front plate for delivery of fuels to burners.

BACKGROUND OF THE INVENTION

Nozzles have long been used to atomize fluids, such as liquids, gases and liquid-solid slurries, to provide fine sprays. One particular application of atomizers that has received considerable attention is in fuel combustion. It is now well known that atomizers that deliver a fine spray of discrete minute droplets improve combustion efficiency.

Thus, considerable work has been done to develop atomizer nozzles (atomizers) that enhance fuel burning efficiency in power plant boilers. It is generally accepted that the finer the fuel spray pattern, the more complete and effective the combustion will be. However, other limitations such as nozzle vibration, tube metal temperatures, opacity of stack gases and nitrogen oxide ($NO_x$) emissions must be considered when designing fuel atomizers.

In about 1989, Todd Combustion, Shelton, Connecticut developed an atomizer that improved the combustion efficiency and to some extent reduced $NO_x$ emissions. The prior art Todd Combustion atomizer was developed for application in a now conventional furnace windbox.

This prior art atomizer is characterized as a Multi-Jet Single Fluid Atomizer. Structurally, the atomizer has a cup-shaped internal whirling chamber into which fuel under pressure is delivered through an array of passages or slots that are arranged tangentially to the whirling chamber. An array of perimeter holes each of which are the same radial distance from the center of the whirling chamber provide passage of the fuel from the whirling chamber to the furnace combustion chamber.

Although the prior art design reduced $NO_x$ emissions over previous designs, the level of $NO_x$ emission was still not satisfactory. As a result considerable research was conducted to obtain an atomizer capable of reducing $NO_x$ emissions to minimal levels.

SUMMARY OF THE INVENTION

It is an object of the present invention to provide an improved atomizer.

It is a further object of the invention to provide an atomizer that will improve boiler combustion efficiency and minimize $NO_x$ emissions.

The invention is an atomizer having a centrally disposed whirling chamber into which fuel under pressure is delivered and a critically arranged array of perimeter holes to provide openings from the centrally disposed chamber to the furnace fire box. The perimeter holes are arranged at an angle to the centerline of the centrally disposed whirling chamber. The angle made by the center line of each perimeter hole to the centerline of the whirling chamber is 40° and the distance from the centrally disposed whirling chamber centerline to the centerline of each perimeter hole at the interior or upstream opening of the perimeter hole is effectively 420/512 times the diameter of the centrally disposed whirling chamber.

DESCRIPTION OF THE DRAWINGS

The invention will be better understood when the description of the preferred embodiment is considered with the following drawings wherein.

DESCRIPTION OF THE PREFERRED EMBODIMENT

The atomizer of this present invention, although having more general application, will be described in the environment of a power plant boiler.

Figure 1:
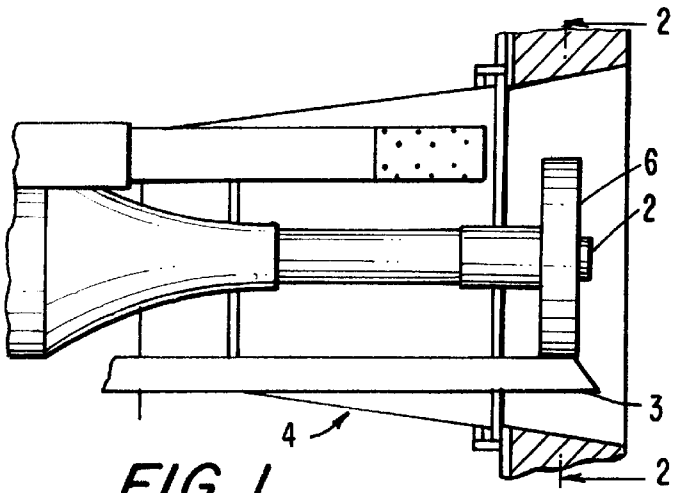
FIG. 1 is a partial sectional elevational view of a furnace wind box in which the present invention is installed.

As seen in FIG. 1, the atomizer 2 of the present invention is centrally dispose in a power plant furnace burner 4. The burner includes a conventional swirler 6 and an array of gas burning poker tubes 3 arranged around the swirler 6.

Figure 2:
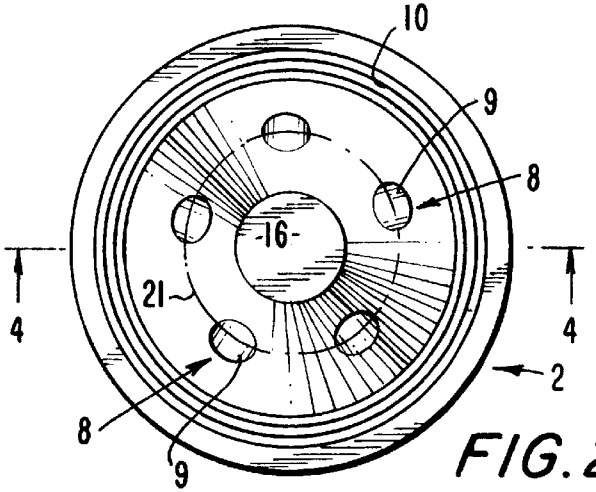
FIG. 2 is a front elevational view of the atomizer of the present invention taken through line 2—2 of FIG. 1.
Figure 3:
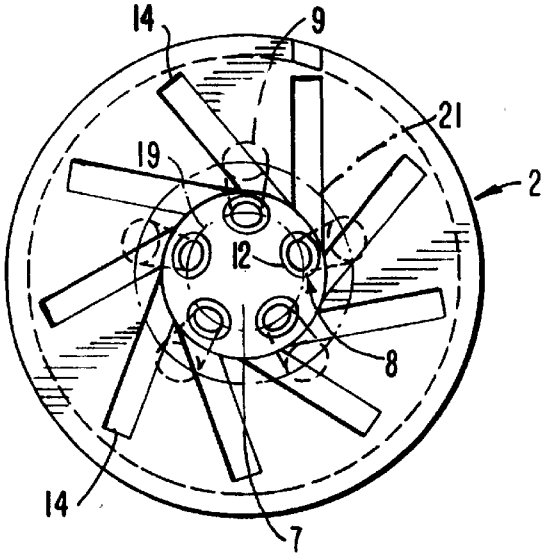
FIG. 3 is a back elevational view of the atomizer of the present invention showing the passages 5 and outer surface openings 8 in phantom.
Figure 4:
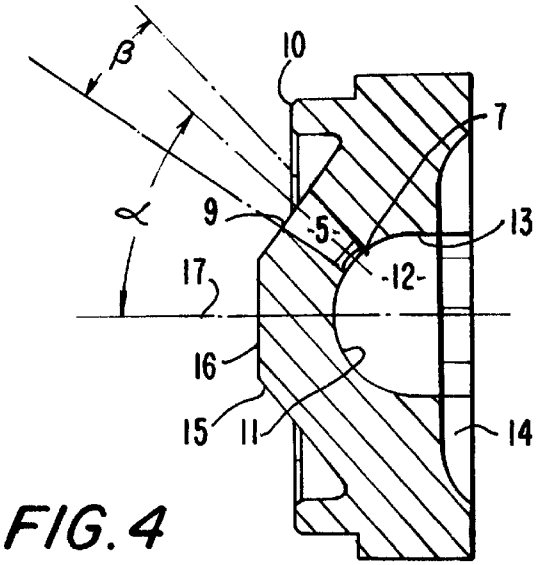
FIG. 4 is a sectional elevational view of the atomizer of the present invention taken through line 4—4 of FIG. 2.

The atomizer 2, as best seen in FIGS. 2, 3 and 4 is provided with a circular array of perimeter holes 8, an external circular flange 10, an internal centrally disposed chamber 12 and a plurality of slots 14 terminating tangentially at the inside upstream opening of the centrally disposed chamber 12. The front surface of the atomizer 2 is a frusto-conical surface 15 terminating in a central circular flat surface 16.

As best seen in FIGS. 2 and 4, the array of perimeter holes 8 comprise five holes equidistant from the centerline 17 of the centrally disposed whirling chamber 12 and from each other. The perimeter holes 8 are formed at an angle $\alpha$ in the range of 25° to 60° and preferably of 40° to the centerline 17 of the whirling chamber. The whirling chamber 12 is formed in a cup-like configuration. The downstream section 11 of the whirling chamber 12 is hemi-spherical and the upstream section 13 is cylindrical. Each of the five perimeter holes 8 has an inner upstream opening 7, an outer downstream opening 9 and a divergent passage 5 having a divergence angle $\beta$, as best seen in FIG. 4. The inner upstream opening 7 is configured in a partial hemi-spherical shape.

In the preferred embodiment the diameter of the cylindrical section 13 is 0.512 inches and the radius of the hemi-spherical section 11 is 0.256 inches. The diameter of a pitch circle 19 made through the center lines of the perimeter holes 8 at the inner upstream opening 7 is 0.420 inches. The diameter of the pitch circle 21 made through the centerline of the outside downstream openings 9 of the perimeter holes 8 is 0.750. The inner upstream opening 7 of each perimeter hole 8 is formed by a ball milk having a 3/16 inch diameter penetrating 0.025 inches into the divergent passage 5. The divergence angle $\beta$ of the divergent passages 5 is 12°. The inner upstream opening 7 of the perimeter holes 8 must be located a distance from the whirling chamber centerline 17 to the whirling chamber diameter greater than the ratio of 400/512; the preferred location being at a ratio of 420/512.

Figure 5:
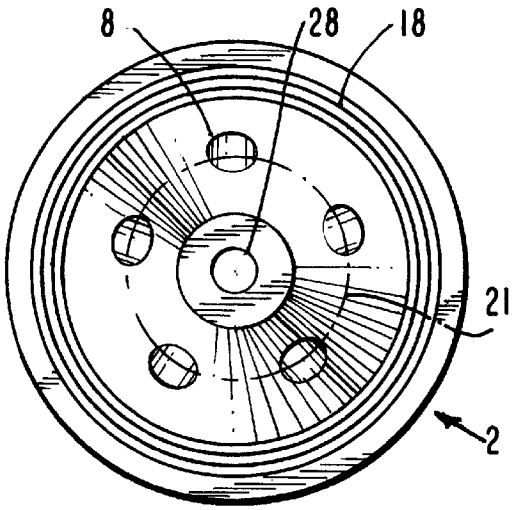
FIG. 5 of a front elevational view of a second embodiment of the atomizer of the present invention.

The embodiment of the atomizer 2 of FIG. 5 is essentially the same as the embodiment of FIGS. 2–4 but includes a centrally disposed hole 28.

Figure 7:
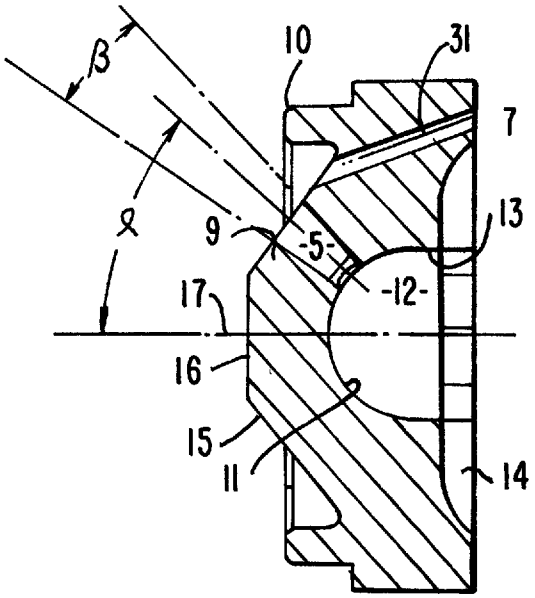
FIG. 7 is a sectional elevational view taken through line 7—7 of FIG. 6.
Figure 6:
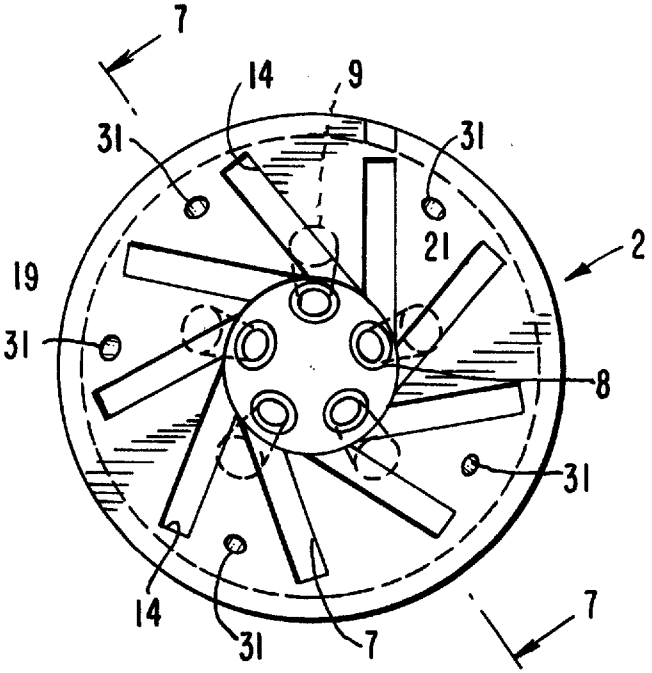
FIG. 6 is a back elevational view of an embodiment of the present invention showing compressed air delivery holes 31.

In the embodiment of FIGS. 6 and 7 an array of passages 31 are provided to deliver compressed air or steam in the range of 60 to 150 psi for the purpose of enhancing atomization as the oil pressure is reduced. The enhanced atomization improves turndown in the range of four to one to ten to one.

In operation heated No. 6 oil under pressure up to 1200 psig, is directed by a backing plate to the outer perimeter of the rear of the atomizer nozzle 2. The oil under pressure enters the atomizer 2 at the outer edge of the slots 14 cut in the rear of the atomizer 2. The oil is accelerated to high velocity in the slots 14, and jets into the whirling chamber 12 at an angle almost tangent to the outer diameter of the whirling chamber 12. This produces a high velocity rotating flow in the chamber that accelerates as the oil proceeds to the perimeter holes 8. Oil passes through the perimeter holes 8, where atomization occurs from a combination of centrifugal force and shearing of the oil by air as it jets into the air stream.

The embodiment of FIG. 5 functions similarly to the embodiment of FIGS. 2–4 but fluidized fuel also discharges from the centrally disposed hole 28. At the exit of the center hole 28, the swirling oil forms a thin film around the perimeter of the hole, which atomizes the oil into small droplets. Centrifugal force from the swirling oil causes the oil to be discharged from the perimeter holes 8 in an enlarging fan pattern, which results in small droplets that ignite easily.

Extensive tests were conducted to develop the atomizer nozzle 2 of the present invention. FIG. 6 displays the improved $NO_x$ emission performance of the atomizer nozzle 2 of the present invention compared to the prior art nozzle. The prior art nozzle identified as the Standard Nozzle differed from the nozzle of the present invention only in the location of the perimeter holes 8. In the standard atomizer nozzle the angle through the center of each perimeter nozzle is 42½°; the interior (upstream) pitch circle is 0.350 inches and the exterior (downstream) pitch circle is 0.680 inches.

A Todd DYNASWIRL - LN burner employing advanced fuel staging for Residual Fuel (RFO) was used in the test. A single conventional differential pressure atomized burner (RFO gun) is located along the burner centerline, inside a gas pipe.

Figure 8:
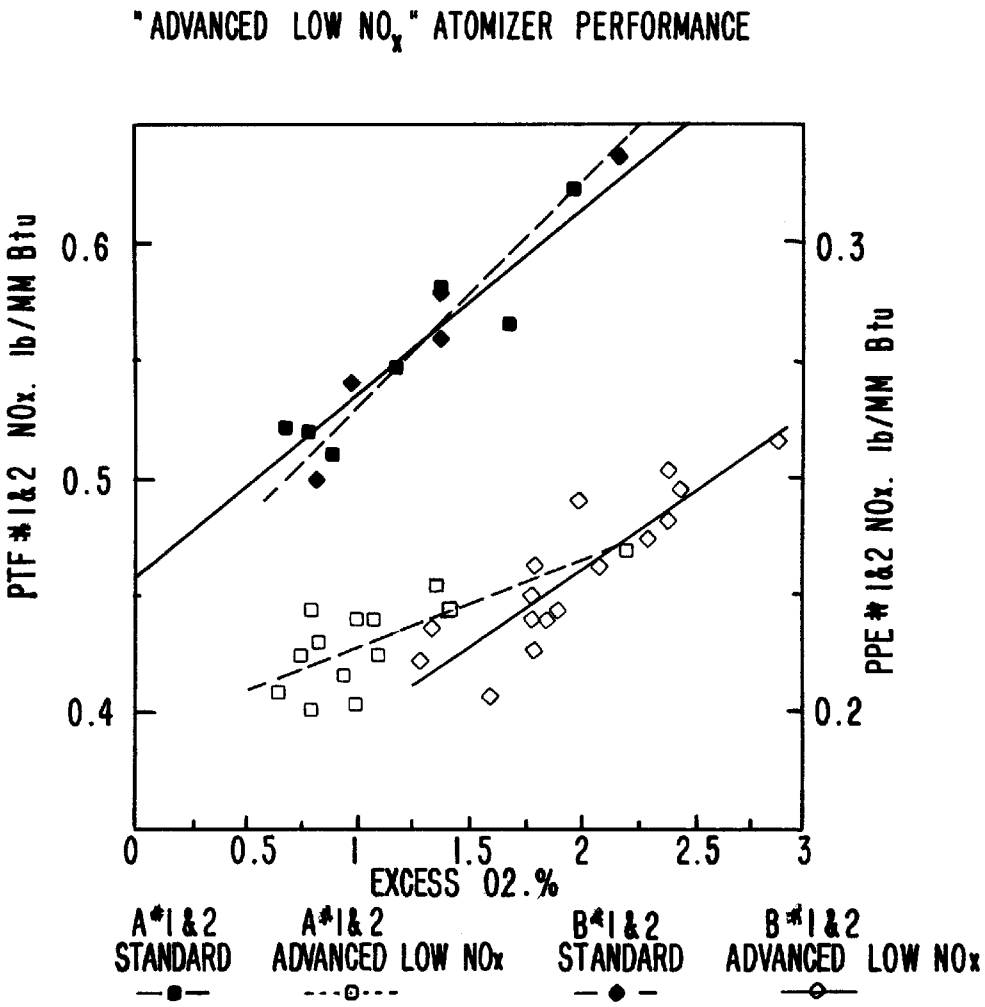
FIG. 8 is a graph illustrating the improved $NO_x$ emission performance of the atomizer of the subject invention.

Through the use of the database developed during the course of the tests, spray lab testing and mathematical modeling, the atomizer nozzle 2 of the present invention was developed and performed to result in a 20% decrease in $NO_x$ as compared to TODD's "Standard" low $NO_x$ tip design. The results are reported on FIG. 8 wherein A #1 and 2 and B #1 and 2 Standard refer to the prior art nozzle and A #1 and 2 and B #1 and 2 Advanced Low $NO_x$ refer to the atomizer 2 of the present invention.

$NO_x$ at A #1 was reduced by 22% from 0.51 lb/MMBtu to 0.40 lb/MMBtu. $NO_x$ at A #2 was reduced by 19% from 0.53 lb/MMBtu to 0.43 lb/MMBtu. $NO_x$ at B #1 was reduced by 22% from 0.27 lb/MMBtu to 0.21 lb/MMBtu. $NO_x$ at B #2 was reduced by 20% from 0.25 lb/MMBtu to 0.20 lb/MMBtu.

The "Advanced Low $NO_x$" Multi-jet atomizer was implemented at six units resulting in significant and consistent $NO_x$ reductions between 18% and 22%.

Although a differential pressure atomizer (return flow atomizer) was used in the tests, the result would be the same for a simplex or non-return flow atomizer.

I claim:

1. In an atomizer having a whirling chamber and holes for discharge of fluid from the whirling chamber, the improvement comprising locating a plurality of the holes a distance from the whirling chamber centerline wherein the distance of each hole from the centerline of the whirling chamber is greater than 400/512 times the diameter of the whirling chamber.

2. An atomizer as in claim 1 wherein each hole has an inlet upstream opening, an outlet downstream opening, a divergent passage extending from said inlet upstream opening to said outlet downstream opening and said divergent passage is inclined at an angle in the range of 25° to 60° to the centerline of the whirling chamber and wherein the distance of each perimeter hole from the whirling chamber centerline is a distance which is a ratio in the range of 420/512 times the diameter of the whirling chamber.

3. An atomizer as in claim 2 wherein the perimeter array of holes comprise five holes each having inlet upstream openings configured in hemi-spherical shape and the divergent passage is inclined at an angle of 40° to the centerline of the whirling chamber and the holes are arranged in an array of perimeter holes each hole being equidistant from the whirling chamber centerline.

4. An atomizer as in claim 3 wherein the whirling chamber has a downstream hemi-spherical section and an upstream cylindrical section and the upstream inlet of each perimeter hole is formed in a partial hemispherical configuration.

5. An atomizer as in claim 4 wherein said whirling chamber hemi-spherical section has a radius of 0.256 inches and the cylindrical section has a diameter of 0.512 inches and the center of the inlet openings of the perimeter holes define a pitch circle of 0.420 inches and the outlet openings of the perimeter holes define a pitch circle of 0.750 inches.

6. An atomizer as in claim 5 further comprising a frusto-conical front surface on the downstream side of said atomizer and wherein the downstream outlet openings of the perimeter holes are on the conical surface of said frusto-conical surface.

7. An atomizer as in claim 3 wherein said atomizer is centrally disposed in a furnace burner.

8. An atomizer as in claim 3 further comprising a plurality of slots upstream as said whirling chamber arranged tangentially to said whirling chamber.

9. In an atomizer having a whirling chamber and holes for discharge of fluid from the whirling chamber, the improvement comprising locating a plurality of the holes a distance from the whirling chamber centerline wherein the distance of each hole from the centerline of the whirling chamber is greater than 400/512 times the diameter of the whirling chamber, wherein each hole has an inlet upstream opening, an outlet downstream opening, a divergent passage extending from said inlet upstream opening to said outlet downstream opening and said divergent passage is inclined at an angle in the range of 25° to 60° to the centerline of the whirling chamber, wherein the whirling chamber has a downstream hemi-spherical section and an upstream cylindrical section and the upstream inlet of each perimeter hole is formed in a partial hemispherical configuration, said atomizer further comprising a frusto-conical front surface on the downstream side of said atomizer and wherein the downstream outlet openings of the perimeter holes are on the conical surface of said frusto-conical surface, said atomizer further comprising a centrally disposed hole aligned with the center line of the whirling chamber.

10. An atomizer as in claim 9 further comprising a circular flange on the downstream surface of said atomizer around the frusto-conical surface.

11. In an atomizer having a whirling chamber and holes for discharge of fluid from the whirling chamber, the improvement comprising locating a plurality of the holes a distance from the whirling chamber centerline wherein the distance of each hole from the centerline of the whirling chamber is greater than 400/512 times the diameter of the whirling chamber, said atomizer further comprising compressed air or steam holes in the atomizer for the delivery of air or steam under pressure to the fuel discharged from the atomizer.

12. An atomizer as in claim 11 wherein the compressed air or steam holes in the atomizer are between the fuel perimeter holes and the outer periphery of the atomizer.

13. A method for burning fuel in a furnace comprising the steps of passing a fluidized fuel into a whirling chamber in an atomizer; discharging the fluidized fuel from the whirling chamber through perimeter holes in the whirling chamber into a furnace fire box; wherein said perimeter holes have inlet openings and outlet openings said inlet opening define a pitch circle located a distance from the whirling chamber centerline greater than 400/512 times the diameter of the whirling chamber and the $NO_x$ level of the combustion gases is 20% below the $NO_x$ level of systems using an atomizer wherein said distance is 350/512 times the said diameter.

14. A method as in claim 13 further comprising the step of delivering compressed air or steam into the path of the fuel discharged from the perimeter holes.

15. A method for burning fuel in a furnace comprising the steps of passing a fluidized fuel into a whirling chamber in an atomizer; discharging the fluidized fuel from the whirling chamber through perimeter holes in the whirling chamber into a furnace fire box; wherein said perimeter holes have inlet openings and outlet openings said inlet opening define a pitch circle located a distance from the whirling chamber centerline greater than 400/512 times the diameter of the whirling chamber and the $NO_x$ level of the combustion gases is 20% below the $NO_x$ level of systems using an atomizer wherein said distance is 350/512 times the said diameter, wherein the fluidized fuel is fuel oil and further comprising the step of delivering the fluidized fuel to the whirling chamber with air under pressure.

16. A method as in claim 15 wherein the pressure of the fluidized fuel and air or steam delivered to the whirling chamber is 1200 psi.

17. A method as in claim 16 further comprising the step of delivering the fluidized fuel to the whirling chamber through slots arranged tangentially to the whirling chamber.

* * * * *